United States Patent [19]

Gaylord

[11] 4,072,143

[45] Feb. 7, 1978

[54] DOUBLE INLET KITCHEN VENTILATOR

[75] Inventor: Edson C. Gaylord, Wilsonville, Oreg.

[73] Assignee: Gaylord Industries, Inc., Lake Oswego, Oreg.

[21] Appl. No.: 726,844

[22] Filed: Sept. 27, 1976

[51] Int. Cl.[2] ..... F24C 15/20

[52] U.S. Cl. ..... 126/299 D; 55/DIG. 36

[58] Field of Search ..... 126/299 D, 299 E; 55/DIG. 36

[56] References Cited

U.S. PATENT DOCUMENTS

| | | | |
|---|---|---|---|
| 3,207,058 | 9/1965 | Gaylord | 55/DIG. 36 |
| 3,400,649 | 9/1968 | Jensen | 126/299 D |
| 3,530,484 | 9/1970 | Courchesne | 126/299 D |
| 3,664,255 | 5/1972 | Kuechler | 126/299 D |
| 3,805,685 | 4/1974 | Carns | 126/299 E |

*Primary Examiner*—Ronald C. Capossela

*Attorney, Agent, or Firm*—Lee R. Schermerhorn

[57] ABSTRACT

A ceiling mounted kitchen ventilator has inlet openings in opposite sides of a vertical exhaust duct for drawing in gases and vapors rising from underlying cooking equipment. The inlet opening on one side is adjustable to vary the ratio of the two opposed confluent flows into the duct. A ceiling mounted canopy surrounds the exhaust duct and overhangs the cooking equipment to capture the contaminated air for treatment and disposal by the exhaust duct. The canopy also provides fresh air make-up for the kitchen, to replace the air removed by the exhaust duct.

8 Claims, 4 Drawing Figures

DOUBLE INLET KITCHEN VENTILATOR

BACKGROUND OF INVENTION

This invention relates to a kitchen ventilator having inlet openings in opposite sides of a vertical exhaust duct for drawing in opposed confluent flows of contaminated air rising from underlying cooking equipment.

Heretofore the various units of cooking equipment in a commercial kitchen have generally been lined up side by side along a common wall. With such an arrangement it was convenient to mount the kitchen ventilator on the wall and extend the width of the ventilator, or at least the hood and inlet throat portions, to the distance necessary to serve all the cooking equipment along the wall. Thus the ventilator and the hood were often quite wide, requiring an excessive amount of sheet metal work to make the hood and ventilating duct, and grease extracting and washing equipment within the duct, in relation to the amount of air being treated.

A more economical and efficient arrangement is to move all the cooking equipment away from the kitchen wall and dispose the various units in two banks back to back in a more compact island type of installation. Then a square, or almost square, canopy type of hood may be provided and the width of the lower end of the ventilating duct may be reduced by about one-half thereby reducing the cost of the ventilator and providing a more efficient kitchen arrangement as well.

The general objects of the invention are, therefore, to provide an improved kitchen ventilator to accomodate an island type installation of the cooking equipment, to provide a kitchen ventilator at reduced cost for a given amount of cooking equipment, to provide a kitchen ventilator having a ceiling mounted ventilating duct and canopy, to provide a grease extracting vertical exhaust duct having inlet openings in its opposite sides arranged to draw in opposed confluent flows of contamined air from opposite sides of an overhanging canopy and to provide a vertical exhaust duct having means to adjust one of said openings to vary the ratio of the two confluent flows of air drawn into the duct.

A more specific object is to adapt the wall mounted type of grease extracting ventilator in Gaylord U.S. Pat. No. 3,207,058 to a ceiling mounted ventilator arranged to serve an island type installation of cooking units in a kitchen.

SUMMARY OF THE INVENTION

In the present construction a ceiling mounted vertical exhaust duct contains a plurality of grease extracting baffles. A grease trough is suspended under the lower end of the duct to collect and dispose of the liquid grease extracted by the baffles. A damper baffle on one side of the duct extends down into the grease trough in the open position of the damper baffle to define an inlet opening for a major air volume over the major cooking load.

On the opposite side of the exhaust duct a second inlet opening is adjustable to draw in a lesser flow of contaminated air from a lighter cooking load on that side of the exhaust duct. A ceiling mounted canopy extends beyond the exhaust duct on both sides to capture the contaminated air. In this way a more compact and efficient kitchen ventilator serves a given number of cooking units arranged back to back in an island type installation away from the wall of the kitchen.

The invention will be better understood and additional objects and advantages will be become apparent from the following detailed description of the preferred embodiments illustrated in the accompanying drawings. Various changes may be made in the details of construction and arrangement of parts and certain features may be used without others. All such modifications with in the scope of the appended claims are included in the invention.

DESCRIPTION OF THE PREFERRED EMBODIMENTS

Figure 1:
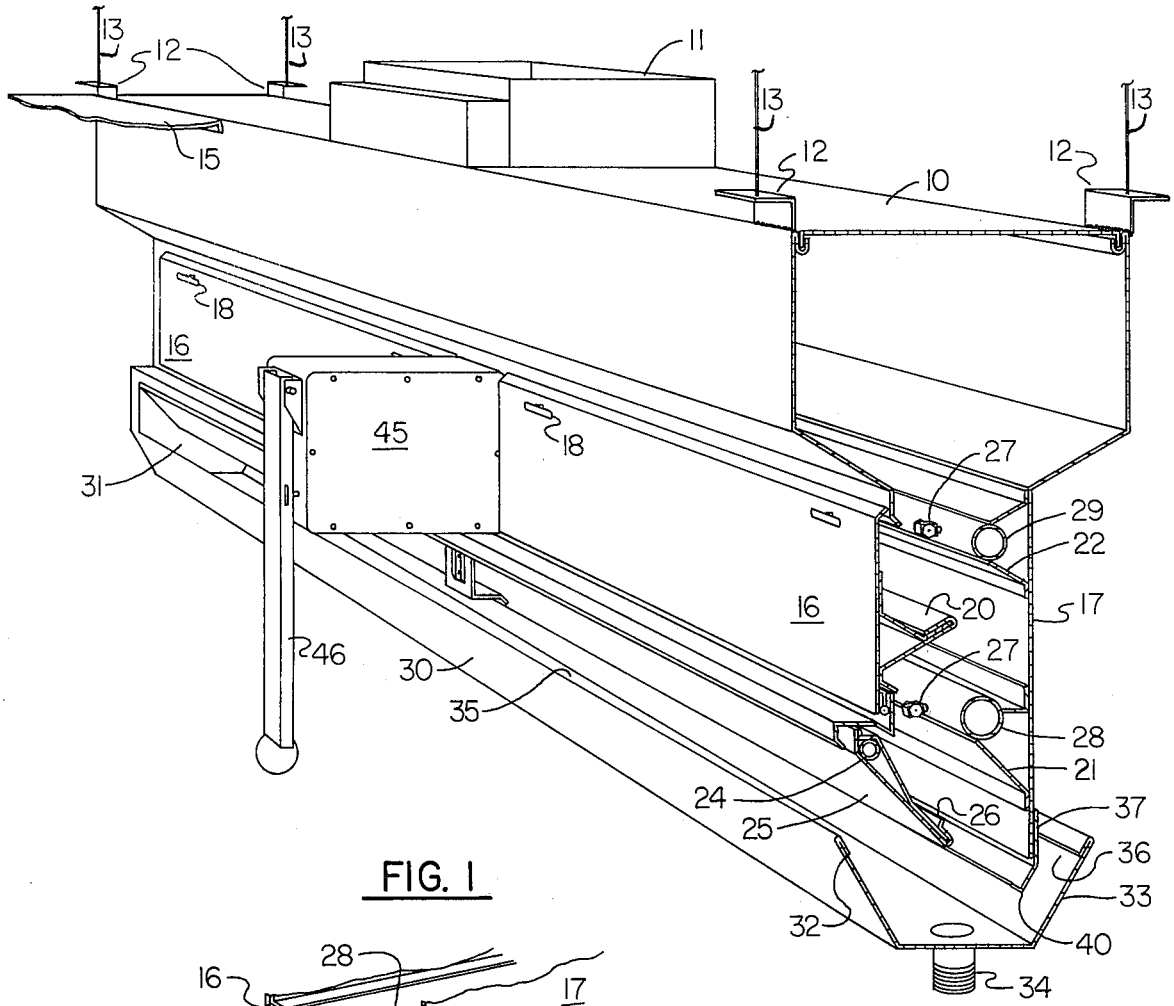
FIG. 1 is a perspective view with parts broken away showing a grease extracting ventilating duct embodying the invention.

In FIG. 1 the sheet metal housing 10 is extended horizontally to form the lower end of a vertical exhaust duct 11. Housing 10 is suspended from the ceiling, or from supports above the ceiling, by brackets 12 and hanger bolts 13. A canopy 15 extending from the top of housing 10 will be described later.

A lower portion of the exhaust duct in housing 10 has a first vertical sidewall 16 and an opposite vertical sidewall 17. The major portion of sidewall 16 comprises two or more panels which may be opened to provide access for cleaning the grease extracting section of the duct. For this purpose the panels at 16 are provided with handles 18 for removing the panels or pivoting them to open positions on hinges at the lower edges of the panels. Each panel at 16 is equipped with a grease extracting baffle 20.

The opposite sidewall 17 is equipped with a lower grease extracting baffle 21 and an upper grease extracting baffle 22. The lower edge of side wall 16 below the removable panels carries a horizontal pivotal mounting 24 for a grease extracting damper baffle 25. The lower edge of the damper baffle 25 is equipped with an inclined grease gutter 26.

The grease extracting surfaces just described are washed from time to time by sprays of hot water and detergent from nozzles 27 on water pipes 28 and 29. Pipe 28 is incorporated in the edge of lower baffle 21 and pipe 29 is incorporated in the edge of upper baffle 22.

Figure 2:
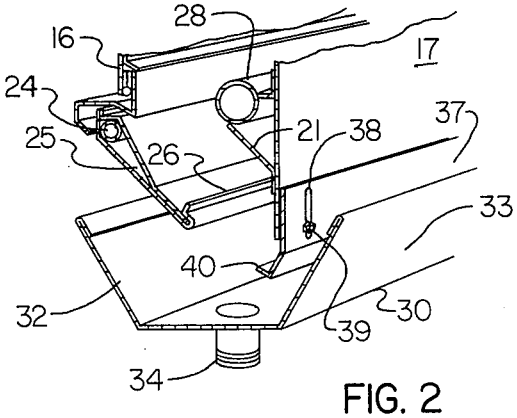
FIG. 2 is a fragmentary perspective view of a portion of FIG. 1.

A grease trough 30 is suspended under the lower end of the exhaust duct by means of end walls 31 on the grease trough connected to the end walls of housing 10. Grease trough 30 has upwardly divergent sidewalls 32 and 33 and a downwardly extending drain pipe connection 34. FIGS. 1 and 2 show damper baffle 25 in open position extending downward into grease trough 30 in spaced relation inside of sidewall 32 to form a primary throat opening or inlet 35 into the exhaust duct on one side thereof. In closed position damper baffle 25 swings up against the underside of grease extracting baffle 21 to close the lower end of the exhaust duct.

On the opposite side of the exhaust duct a secondary throat opening 36 is adjustable to vary the ratio of the opposed confluent flows of contaminated air drawn into the exhaust duct through the inlet openings 35 and 36. This is accomplished by an adjustable plate 37 which may be shifted vertically on the lower edge portion of side wall 17. Plate 37 is provided with vertical slots 38 to receive bolts or screws 39 in side wall 17.

For maximum throat opening at 36 the plate 37 is raised to an upper position providing the maximum spacing between the lower edge of plate 37 and the bottom or side wall 33 of trough 30. Inlet opening 36 may be closed, or substantially closed, by dropping plate 37 down to its lowermost position.

The lower edge of plate 37 is equipped with an inwardly upturned flange forming an inclined grease gutter 40. The purpose of grease gutters 26 and 40 is to convey liquid grease therein into the trough 30 at a point removed from the main flows of air passing through inlet openings 35 and 36 so that drops of grease descending into trough 30 will not be recaptured by the air streams and carried upward into the exhaust duct.

Thermostats in the exhaust duct close damper baffle 25 in the event of fire and water is supplied through pipes 28 and 29 and nozzles 27 to extinguish any grease fire in the grease extracting section of the duct just described. A time controlled washing and drying cycle activating the nozzles 27 is also provided to clean the grease out of the grease extracting section at least once a day.

Damper baffle 25 and nozzles 27 are controlled by an electrical system which includes a control box 45 mounted on the ventilator as described in the Gaylord U.S. Pat. No. 3,207,058. As described in said patent, control box 45 includes certain manual functions to activate the fire extingushing system before the thermostats have had time to respond, to reopen damper baffle 25 after a fire has been extinguished and for start up operation in the morning. Such manual functions are facilitated by a downwardly extending handle lever 46 on the ontrol box which provides better access to the operator when the ventilator is mounted in a relatively high position above the floor.

Figure 3:
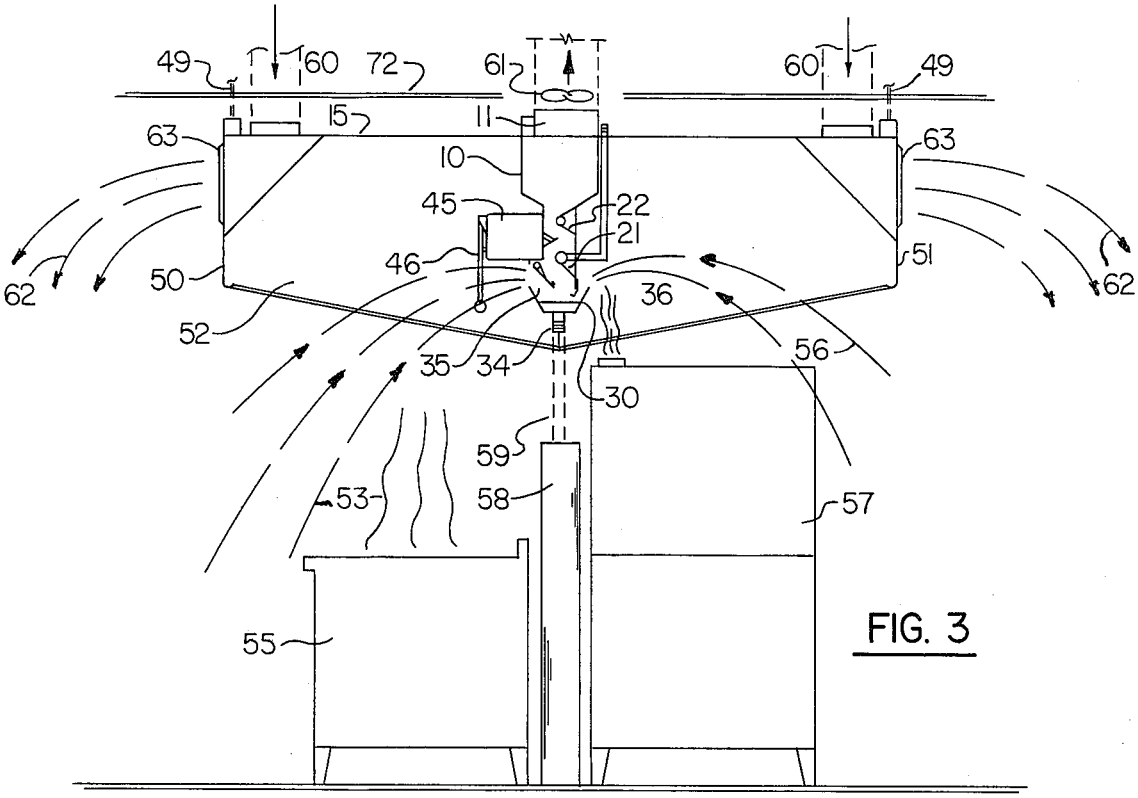
FIG. 3 is a vertical sectional view showing a typical kitchen installation including a canopy over the cooking equipment.

As shown in FIG. 3 the canopy 15 is rectangular having opposite vertical sidewalls 50 and 51 and opposite vertical end walls 52, all suspended by hanger bolts 49. Primary inlet throat 35 receives a major flow 53 of contaminated air on one side of the canopy from an underlying major cooking load in one bank of cooking units 55. Secondary inlet throat 36 receives a secondary flow 56 of contaminated air on the opposite side of the canopy from an underlying lighter cooking load in another bank of cooking units 57 such as ovens and steamers.

In the present illustration the two banks of cooking units 55 and 57 are disposed back to back in an island arrangement away from any boundary wall of the kitchen. There may be a low wall 58 between the two banks of cooking equipment and this wall may contain a drain pipe 59 extending from drain connection 34 on grease trough 30. Wall 58 may extend up into canopy 15 if desired. If the bank of cooking units 57 is not to be used for an extended period of time the secondary inlet opening 36 may be closed, or substantially closed, as described above.

Canopy 15 is preferably provided with make-up fresh air ducts 60 to replace air withdrawn from the kitchen by fan 61 in exhaust duct 11. Flows 62 of fresh air make-up enter the kitchen from discharge openings 63 in the opposite sidewalls 50 and 51 of canopy 15.

Figure 4:
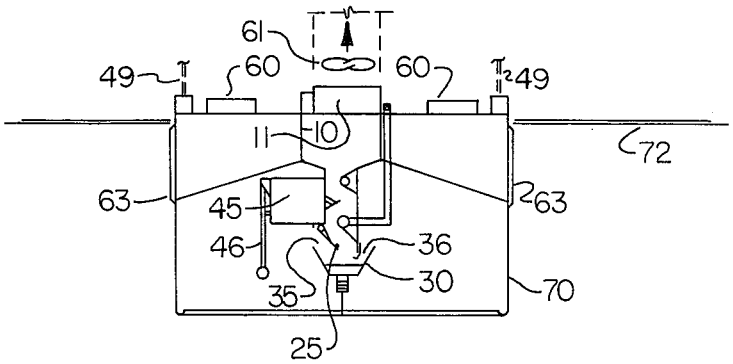
FIG. 4 is a similar view showing a different arrangement.
Figure 4:
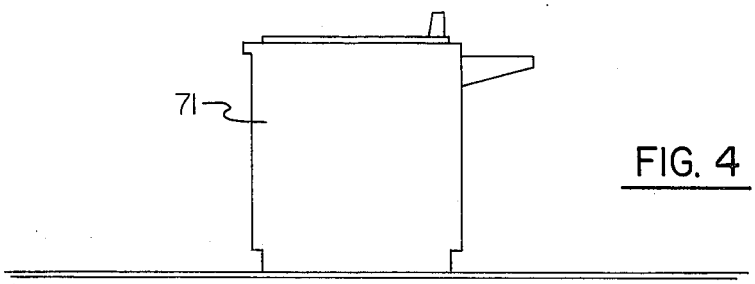

FIG. 4 shows how a smaller canopy 70 and grease extracting exhaust duct may be ceiling mounted over an island installation of a single bank of cooking units 71 to provide the advantages described above. Canopy 70 is suspended by hanger bolts 49 from supports above the ceiling 72 but both the canopy and exhaust duct housing 10 may be mounted on the ceiling, if desired.

What is claimed is:

1. A ceiling mounted kitchen ventilator having a double inlet for opposed confluent flows of gases and vapors from underlying cooking equipment, comprising a vertical exhaust duct suspended from said ceiling, grease extracting baffles projecting into said duct from opposite vertical side walls thereof, a grease trough above said cooking equipment suspended beneath the lower end of said exhaust duct, side walls on said trough having upper edges disposed outward from said duct side walls, a damper baffle hinged at the lower edge of one of said duct side walls, said damper baffle having an open position with its lower edge extending into said trough in spaced relation to one of said trough side walls to form an inlet opening for a flow of said gases and vapors on one side of said trough, said damper baffle having a closed position engaging one of said grease extracting baffles on the opposite side of the duct to close the lower end of the duct, and a lower edge on the opposite side wall of the duct extending into said trough in spaced relation to the opposite side wall of the trough to form a second inlet opening for a confluent flow of said gases and vapors from the opposite side of the trough when said damper baffle is in said open position, the closing of said damper baffle shutting off both of said inlet flows of said gases and vapors.

2. A kitchen ventilator as defined in claim 1, said side walls of said grease trough being upwardly divergent and said lower edge of said opposite side wall of said duct being inclined parallel with said opposite side wall of said trough.

3. A kitchen ventilator as defined in claim 1 including vertical adjustment means for said lower edge of said opposite side wall of said duct to vary the ratio of said confluent flows of gases and vapors drawn into said duct.

4. A kitchen ventilator as defined in claim 3, said lower edge of said opposite side wall of said duct being movable downward into engagement with said grease trough for optionally closing said second inlet opening.

5. A kitchen ventilator as defined in claim 1 including an inwardly upturned flange on said lower edge of said opposite side wall of said duct forming a grease gutter.

6. A kitchen ventilator as defined in claim 1 including a ceiling mounted canopy having depending side and end walls, the side walls of said canopy being spaced outwardly away from said opposite side walls of said exhaust duct.

7. A kitchen ventilator as defined in claim 6 including fresh air inlet ducts in said canopy having outlets in said side walls of the canopy for discharging fresh air into the kitchen from opposite sides of the canopy.

8. A kitchen ventilator comprising a ceiling mounted canopy having depending side walls arranged to capture and confine contaminated air rising from underlying cooking equipment, a ceiling mounted vertical exhaust duct centrally positioned in said canopy, air inlet openings in opposite sides of said exhaust duct for drawing opposed confluent flows of said contaminated air into said duct from opposite sides of said canopy, means for adjusting the size of said air inlet opening in one side of said exhaust duct to vary the ratio of said opposed confluent flows of contaminated air from said opposite sides of said canopy, and fresh air inlet ducts in said canopy having outlets in said side walls of the canopy arranged to discharge all of said fresh air into the kitchen outwardly away from said canopy.

* * * * *